US005660337A

United States Patent [19]

Falbo et al.

[11] Patent Number: 5,660,337

[45] Date of Patent: Aug. 26, 1997

[54] CRUSHING MACHINE WITH JAWS, PARTICULARLY ADAPTED TO THE RECYCLING OF MATERIALS

[75] Inventors: Dario Falbo; Franco Carlesso, both of Ponzano Veneto, Italy

[73] Assignee: Officine Meccaniche Di Ponzano Veneto S.P.A., Italy

[21] Appl. No.: 615,240

[22] PCT Filed: Sep. 13, 1994

[86] PCT No.: PCT/IT94/00147

§ 371 Date: May 2, 1996

§ 102(e) Date: May 2, 1996

[87] PCT Pub. No.: WO95/07756

PCT Pub. Date: Mar. 23, 1995

[30] Foreign Application Priority Data

Sep. 15, 1993 [IT] Italy ..... TV9300042 U

[51] Int. Cl.[6] ..... B02C 1/02

[52] U.S. Cl. ..... 241/37; 241/264

[58] Field of Search ..... 241/33, 36, 37, 241/264, 265, 266, 267, 268, 269

[56] References Cited

U.S. PATENT DOCUMENTS

| | | | |
|---|---|---|---|
| 2,982,481 | 5/1961 | Osborne et al. | 241/32 |
| 3,099,406 | 7/1963 | Kautz | 241/32 |
| 3,959,897 | 6/1976 | May | 241/264 X |
| 4,398,674 | 8/1983 | Dremann | 241/30 |
| 4,406,416 | 9/1983 | Tateishi | 241/269 |
| 4,410,145 | 10/1983 | Koch | 241/264 |
| 4,637,562 | 1/1987 | Hagiwara et al. | 241/259.2 |
| 4,749,132 | 6/1988 | Hagiwara et al. | 241/30 |
| 4,765,546 | 8/1988 | Stewart | 241/36 |

FOREIGN PATENT DOCUMENTS

| | | |
|---|---|---|
| 0 433 500 A1 | 9/1991 | European Pat. Off. . |
| 1 164 211 | 2/1964 | Germany . |
| 1 237 414 | 3/1967 | Germany . |
| 52-078157 | 7/1977 | Japan . |
| 648433 | 1/1951 | United Kingdom . |

*Primary Examiner*—John M. Husar
*Attorney, Agent, or Firm*—Leonard Bloom

[57] ABSTRACT

Crushing machine with jaws (4, 5) regulating the size of the material in exit by means of a controlled distance, between the fixed (5) and mobile jaw (4) and with a safety device against uncrushable material blocks, composed of interposed oleo-hydraulic cylinders between one of the jaws and the body (1), the said cylinders (7) being connected to an oleo-hydraulic circuit with valves of maximum pressure.

3 Claims, 7 Drawing Sheets

CRUSHING MACHINE WITH JAWS, PARTICULARLY ADAPTED TO THE RECYCLING OF MATERIALS

TECHNICAL FIELD

The present innovation is an evolution of the patent entitled "Frantumatore alternativo", (reciprocating crusher) filed on 19th Dec. 1990 at the Provincial Office of Industry, Commerce and Artisanship of Venice with number IT-A-61977 B/90 and concerns a new crushing machine with mouth opening adjustable jaws to allow exit of different sizes of the material, by means of the control of the distance between the fixed and mobile jaws, and with a safety device against uncrushable material blocks that may accidentally enter into the crushing chamber.

BACKGROUND ART

The crushing machines with traditional jaws exploit the principle of the breaking of the material that is being compressed between two jaws, of which one is fixed and the other mobile, the mobile jaw being operated by an eccentric power-operated shaft that acts on the upper side and by an articulation of a connecting rod that acts on the lower side, in the crusher called "a simple toggle", or the hinged mobile jaw being linked to the frame in the upper part and operated by an eccentric power-operated shaft through a double articulation connecting rod, in the crusher called a "double toggle". As is known, the traditional crushing machines have a correction system for the size of the material in exit which is awkward to use, being composed of a series of thicknesses inserted or removed between the connecting rod and the casing when the machine is standstill, with consequent laboriousness and known that in such machines the use of the safety device against blocks of uncrushable material is remarkably unsuitable and wasteful, this device being composed of the well known connecting rod or other breakable component that permits the mobile jaw to space itself from the fixed one beyond the correction/value, in order to eliminate the uncrushable material without giving rise to further and more serious damages to the machine. Since the security system is based on the breaking of a component, the relative reset involves an non-functional machine for many hours, for the replacement of the component and a notable cost for the material and labour.

U.S. Pat. No. 3,099,406 (H. A. P. KAUTZ) discloses an Ore Crusher having two opposed reciprocating jaws (10–21). The jaws being hinged upwards in the entry mouth and the reciprocation being operated backwards in their exit mouth; in which there is a release cylinder (C-3) to allow accidental enlargement.

This solution does not allow adjusting the exit mouth opening, but only safety against overpressure of a larger block not crushed. Furthermore oscillation being on their basis, does not supply an efficient and progressive crushing.

EP-A-0433500 (J. ALTIMAYER) discloses as the previously described IT-A-61977 B/90, a Rock crusher using a fixed jaw (1) and a reciprocable Jaw (16), said reciprocable jaw being eccentrically reciprocated in its upwards eccentric hinging (in the entry mouth). The reciprocable jaw having downwards and on its back a safety cylinder (double acting hydraulic ram 50) to allow opening of the exit mouth when excess of crushing pressure happens in the exit mouth.

In this solution the security cylinder (50) has a strongly limited allowable excursion because of the rigid connection ends of the cylinder (56–54).

In this solution spring clearance recovering device is provided (30–36).

GB-A-648443 (K. GAULDIE) discloses a two opposed Jaw crusher, having a fixed jaw and an hydraulically operated reciprocable jaw (12).

The hydraulic reciprocation being made by a cylinder (14) having both functions of reciprocation and of overpressure yielding.

The connection being made by simply pushing stem head in sliding contact with a vertical back surface on the basis (exit mouth opening) of the reciprocable jaw. Said mobile jaw being free hinged in upper side entry mouth opening.

This solution having a recovery clearance device (18–17*a*) as the previous one.

DE-B-1164211 (MASCHINENFABROK KÖOPPEREN & Co. K. G.) discloses crusher structured as the previous one.

U.S. Pat. No. 4,749,132 (T. HAGIWARA) discloses: a crusher as per EP-A-0433500 with the difference to have an intermediate security pillar-bit or push-bit ("pivot" in the following description of this invention), and the stem of the cylinder being slidable in axial guide (3).

The push-bit being freely articulated in opposite ends by "rotula" connection.

This rotula connection being a unilateral rotary coupling.

DE-B-1237414 (KLÖKENER-HUMBOLDT-DEUTZ AG.), discloses a crusher having both jaws freely hinged in entry mouth, the reciprocation being not made in their hinging.

The push-bar device being on one side and the yielding cylinder being on the other side on the other opposite jaw.

The cylinder articulation ends are made by pin-hinging that can cause easy breakage of the pins because of movement impressed to the respective jaws (5).

U.S. Pat. No. 2,982,481 (R. G. OSBORNE) discloses a crusher having a fixed jaw and an upside eccentrically hinged jaw, having in the back exit end a safety push-bar connection (183) that discharges in a very complicated way the excess of effort for exit overpressure to a very complicated mechanism, unable to allow wide regulation of the exit mouth opening, even if it uses a flag media (132) with two opposed security push-pars (115–137), in particular because these two opposed push-bars are not well articulated at their ends. The respective yielding safety hydraulic device (146, 149) does not provide adjustment of the exit opening of the jaws.

Patent Abstracts of Japan Vol. 1, no.137 (M-046) 11-Nov. 1977 Kokai No.52-78157 disclose: a crusher having a similar flag-push-bar couple security device on one side and security cylinder on the other.

Considering the data above, the drawbacks of the traditional crushing machines are evident, especially if utilized in crushing with the aim of recycling materials arising from demolitions, inasmuch as it is not possible to alter, with ease and continuity, the size of the material in exit during the functioning of said equipment and it is not possible to rapidly reset the machine once the security system has intervened The aim of the present invention is precisely that of highlighting the aforementioned drawbacks and to define a crushing machine characterized by the possibility of varying with continuity, the size of the material in exit, during the normal functioning of the apparatus, and characterized by the fact that the security system against uncrushable material blocks is immediately able to be reset after the intervention.

More specifically, the device that allows the adjustment of the distance between the fixed and mobile jaws can assume different relative configurations, all characterized by the use of oleo-dynamic cylinders that act, depending on the solutions illustrated below, on the fixed jaw, on the mobile jaw, on the well known connecting rod or on one of the connecting rods in case of mills with double toggle.

In all the solutions that will be illustrated, the security function against uncrushable material blocks is entrusted to the oleo-hydraulic cylinders, connected to a circuit with one or more valves of maximum pressure that allows the discharge of the oil contained in the cylinders in case the pressure corresponding to the established maximum is exceeded, allowing the opening of one of the jaws and the consequent exit of the uncrushable block.

In what follows five preferential realizations are described that take as reference, the typological constructive scheme of a simple connecting rod crusher, for reasons of simplicity in the description. The same preferential realizations can make reference to the typological constructive scheme of the double toggle crusher, without changing the functional mode of the crusher operation.

According to a preferential realization of the present invention, the cylinders that carry out the double function of regulation of the distance between the jaws, determining the size of the blocks, are connected by means of rotary bilateral couplings, that are spherical articulations (rotula articulation), respectively to the mobile jaw and to the body of the machine. In this way, said cylinders, besides performing the two functions of correction and safety mentioned above, also replace the well known connecting rod, (traditionally, in the conventional crusher, to perform the safety function against uncrushable material blocks), whose breakage is pre-established. A normal oleo-hydraulic distributor allows the regulation of the opening of the jaws, while one or more valves of maximum pressure, duly calibrated, and of appropriate size, allow the rapid opening of the jaws to eliminate the block of uncrushable material, once the effort that is being used to generate itself for the presence of said block between the jaws, allows the calibration pressure of the valves in the cylinders, to be overcome. The rotary couplings between oleo-hydraulic cylinders and mobile jaw and between the said cylinders and body may be of a unilateral type, as in the case of two cylindrical surfaces, one concave, and the other convex, with more or less the same radius, or two spherical surface segments, being in this case necessary to prearrange a known tensioning system of the movable jaw towards the body, of the pulling and spring type or oleo-hydraulic cylinder connected to an oleo-pneumatic accumulator. In case the rotary couplings are of the bilateral type, the function of the tensioning may be carried out from the said oleo-hydraulic cylinders connected from the side of the stem with an oleo-pneumatic accumulator.

According to this invention, the oleo-hydraulic correction and safety cylinders do not act directly on the mobile jaw, as in the solution described above, but on the well known push connecting rod linked to the mobile jaw through an intermediate flag, the latter being hinged to the upper part of the isolated dihedral from the passing surfaces of the said cylinders and the well known connecting rod, or on the underside depending on the movements that one wishes to allow at the extremity of the flag, where the rotary couplings of the well known connecting rod and the cylinders converge. The evident advantage of this solution, (mechanically more complex with respect to the preceding), consists in being able to utilize a conventional type connecting rod with their own rotary couplings known and experimented in the technique, and to entrust to the cylinders only the opening adjusting and safety functions, without soliciting the rotary couplings of the same cylinders with continuos movements, these couplings having a very modest relative motion only in the correction case of the distance between the jaws or of the entering into function of the safety device against uncrushable material blocks, but not during the normal functioning, at numerous cycles per second, with less consequent wear and functioning reliability. Another advantage of this solution is in the sizing of the oleo-hydraulic cylinders that, if they lie on the surface not coinciding with the surface of the well known connecting rod, forming the two planes into a dihedral angle, may be expedited with less effort than if the case were coplanar to the well known connecting rod, depending on the amplitude of the above mentioned dihedral angle. In this case the effort coming from the well known connecting rod would discharge itself in part directly on the frame by means of the intermediate flag guide, being-able to utilize cylinders of smaller bore or make them work at a lower pressure, with repercussions on the cost or on the reliability of oleo-hydraulic components. Finally with this solution, when the surface of the well known push connecting rod and that of the cylinders almost coincide, it is possible to maintain, for the end part of the movable jaw, the same optimal trajectory that has been defined in the kinematics project site of the machine, also varying the opening of the jaws a great deal and therefore the size of the shattered material in exit.

In the solution described above, the rotary (rotula) couplings of cylinders and of the connecting-bits may be of unilateral or bilateral type, according to known technical solutions, necessitating the first type of tensioning system in the opposite direction of binding to hold everything mounted, the said operative tensioning system may also function as a system of recovering mechanical clearance due to the wearing of materials, the said system being composed of one or more oleo-hydraulic cylinders connected to an oleo-pneumatic the coupling clearances.

The invention is now better disclosed with reference to the attached drawings that illustrate different realizations in which only FIGS. 2,6,7 have to be considered representative of this invention being the others anticipated in the respective structures, corresponding to the descriptions made above, supplied only for illustrative purposes, however not limiting in as much as technical or constructive variations may always be introduced without diverging from the present innovation. In the said drawings.

Figure 1:
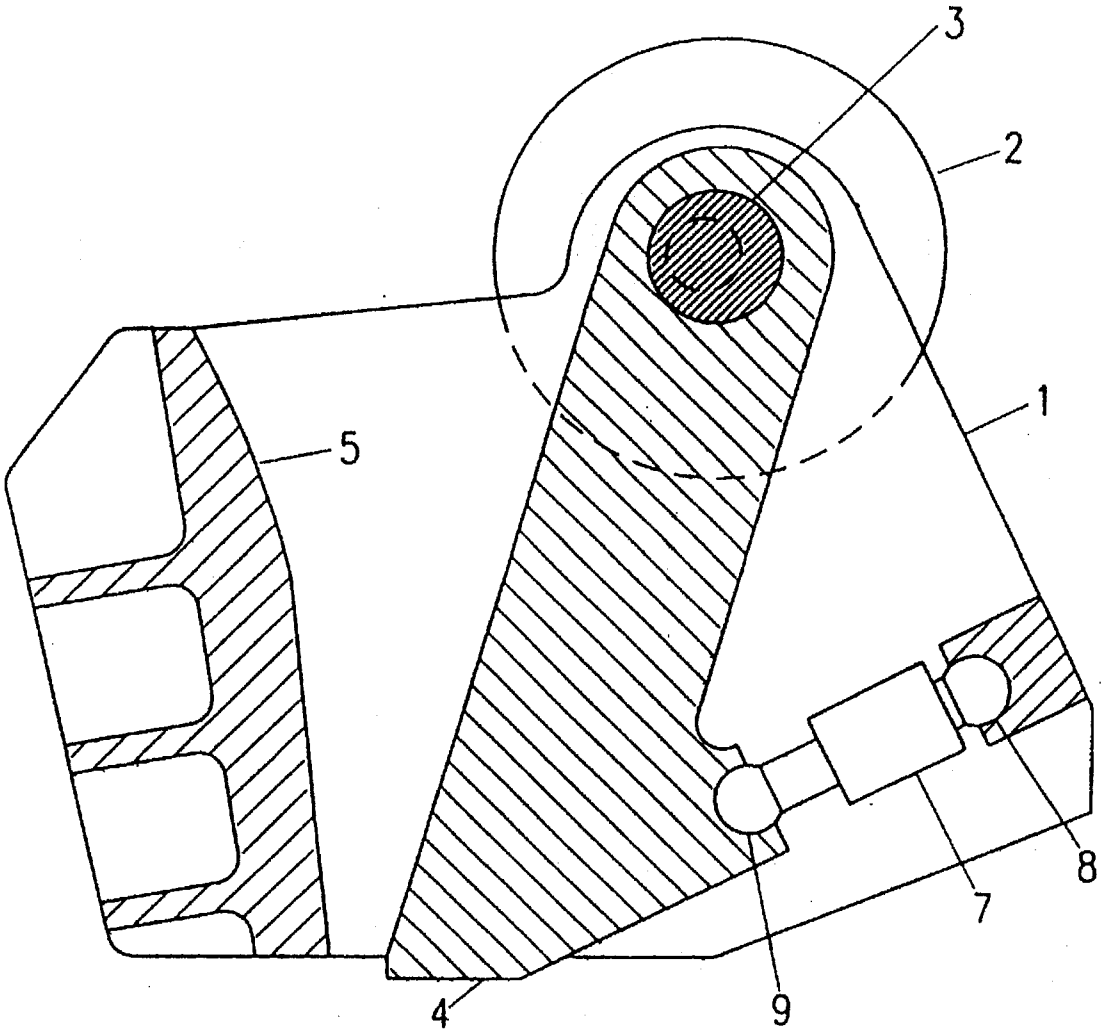
FIG. 1 shows a section of the crushing machine in its most simple constructive form which structure corresponds to EP-A-0433500 (J. ALTIMAYER prior art differing from it by the new idea of rotula connection of the oleo-hydraulic cylinder means.
Figure 2:
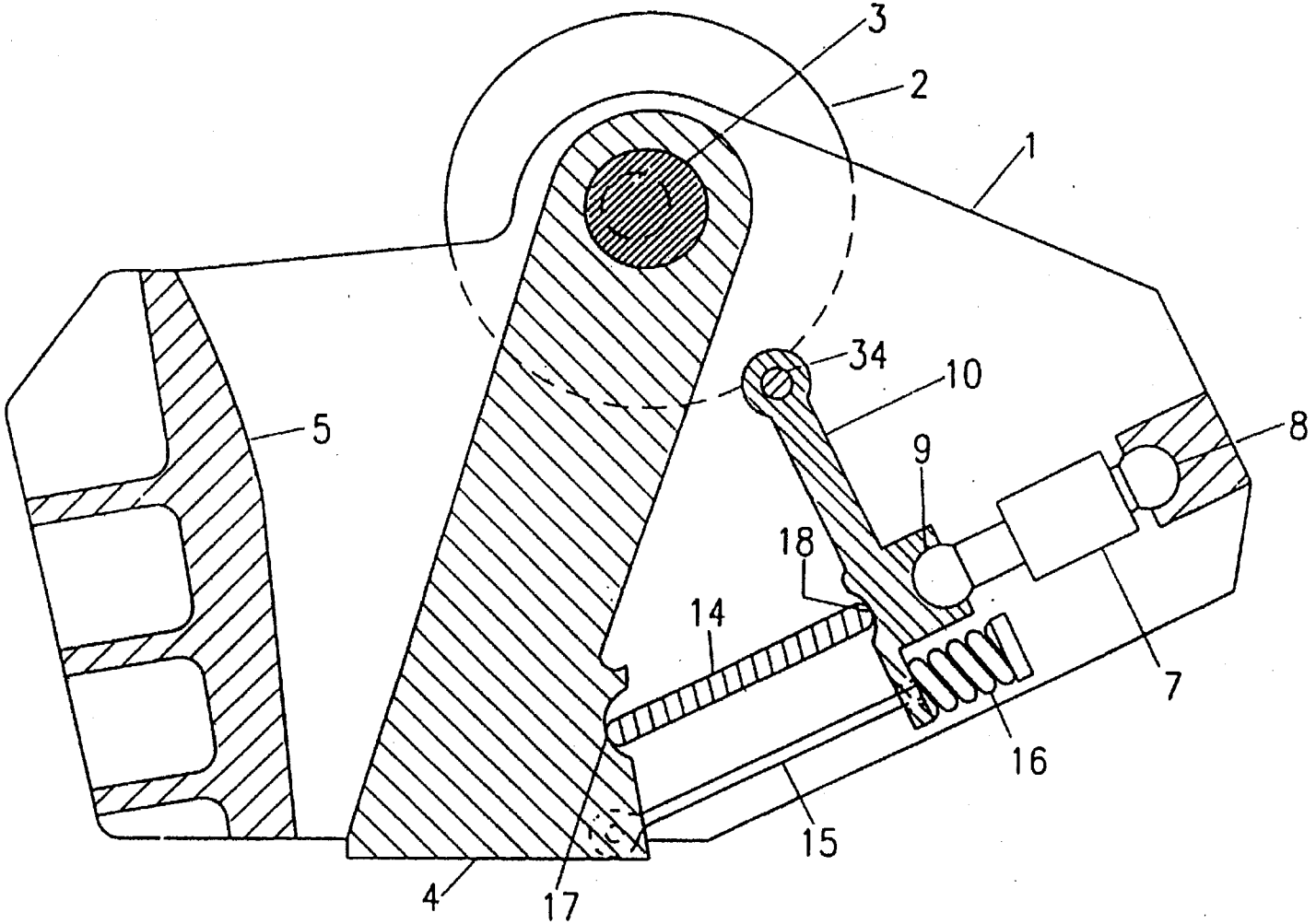
FIG. 2 shows a section of the new crushing machine in its realizable form as per this invention with intermediate flag guide between the well known connecting rod and the correction and safety cylinders.
Figure 4:
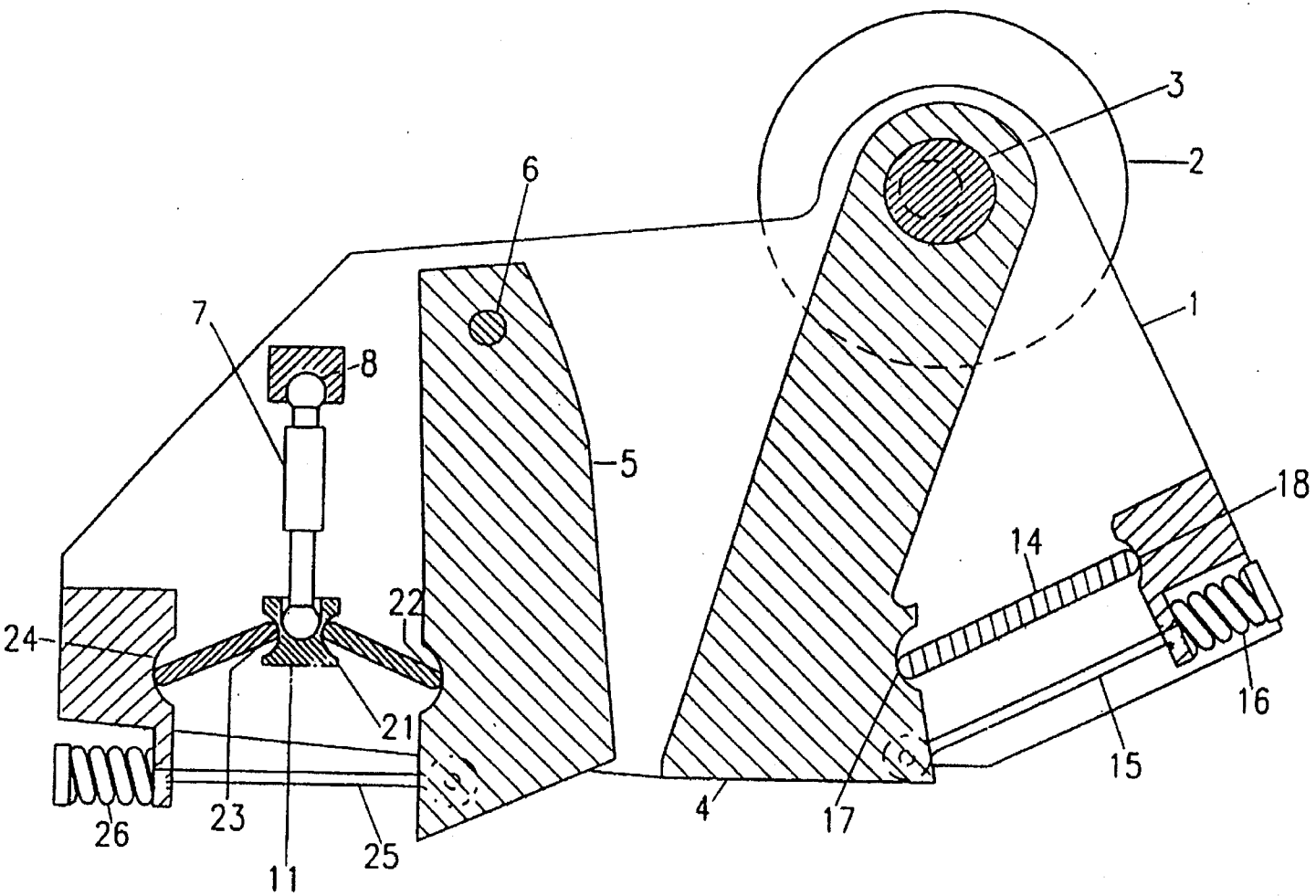
FIG. 4 shows a section of the crushing as per patent Abstracts of Japan Vol.1, no.137 (M-046) 11-Nov. 1977 Kokai No.52-78157 structure that provides the correction and safety cylinders that act on the fixed jaw through two opposite connecting-bits with unilateral rotary couplings.
Figure 5:
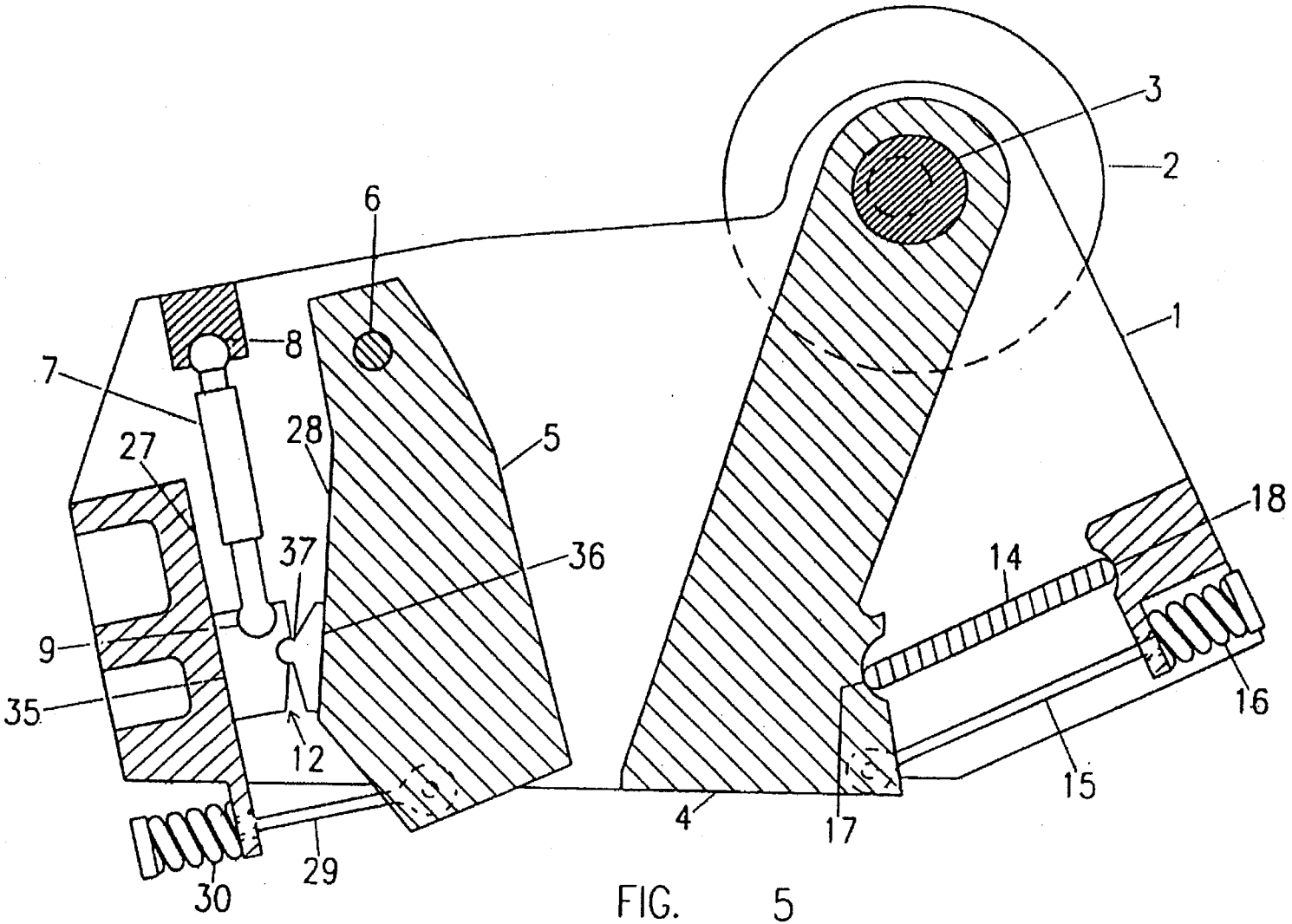
FIG. 5 shows a section of the crushing machine that provides the correction and safety cylinders that act on an articulated wedge placed behind the fixed jaw, in a structure close to the previous one.

With reference to the Figures, 1 indicates the body of the crushing machine, 2 the solid flywheel with the eccentric shaft 3, which is connected with bearings, which, for simplicity, are not represented in the Figures, both to the body 1 and mobile jaw 4. Furthermore 5 is the fixed jaw that in FIGS. 1 and 2 is solid with the body of the machine, while in FIGS. 3, 4 and 5 it is hinged to the said body by means of the pivot 6. Number 7 represents one of the correction and safety cylinders that from one side is connected in all the Figures to the body 1 by means of the rotary coupling 8 and from the other it is connected by means of the rotary coupling 9: to the mobile jaw 4 in FIG. 1, to the connecting flag bit 10, hinged to the body 1 by means of the pivot 14, in FIG. 2, to the fixed jaw 5 in FIG. 3, to the shackle 11 in FIG. 4, and to the articulated wedge 12 in FIG. 5. The element 14 is the traditional and well known connecting rod with unilateral cylindrical couplings 17 and 18 which are found in the crushing machines with jaws; analogously 15 is the tie rod that with the spring 16 traditionally forms the tensioning system that maintains the said connecting rod 14 in position and recovers the clearance due to the wear of the said cylindrical couplings 17 and 18. The dividing device of the effort coming from the fixed jaw of FIG. 4 is made up of two connecting-bits 19 and 20 with unilateral cylindrical couplings 21, 22 and 23, 24 respectively, held in position by the above mentioned shackle 11, having the said effort dividing device of a traditional tensioning system for the maintenance in position of the different components and the recovery of clearances, composed of tie rod 25 and spring 26. In FIG. 5 the dividing device of the effort coming from the fixed jaw 5 is formed of two sliding surfaces 27 and 28 between them inclined and the articulated wedge 12, composed of two elements 35 and 36, in contact respectively with the sliding surfaces 27 and 28, these being solid surfaces respectively to the body 1 of the machine and to the fixed jaw 5. Since the coupling between the articulated wedge 12 and the sliding surfaces 27 and 28 realizes a unilateral bond, a traditional tensioning system and recovery of clearances, formed by tie rod 29 and spring 30 renders the said bilateral bond.

Figure 6:
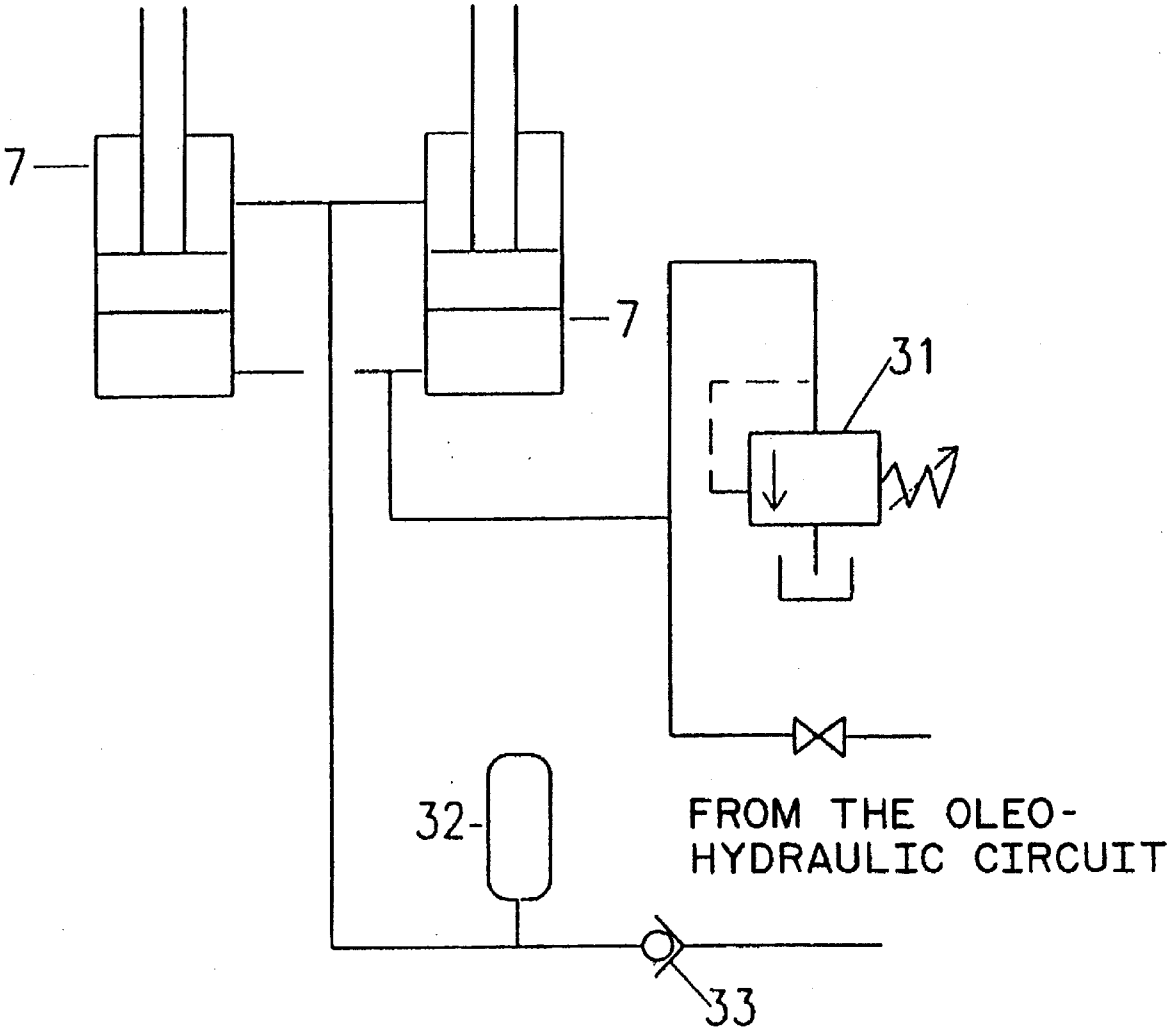
FIGS. 6 and 7 show possible schemes of hydraulic connections that allow the cylinders to carry out the safety function against uncrushable material blocks and the correction of the jaws, rotary couplings.

In the oleo-hydraulic scheme of FIG. 6, applicable to cylinders equipped with rotary bilateral couplings, with 7 the correction and safety cylinders are indicated and in 31 the maximum pressure valve; 32 an oleo-pneumatic accumulator and 33 a unidirectional valve.

Figure 7:
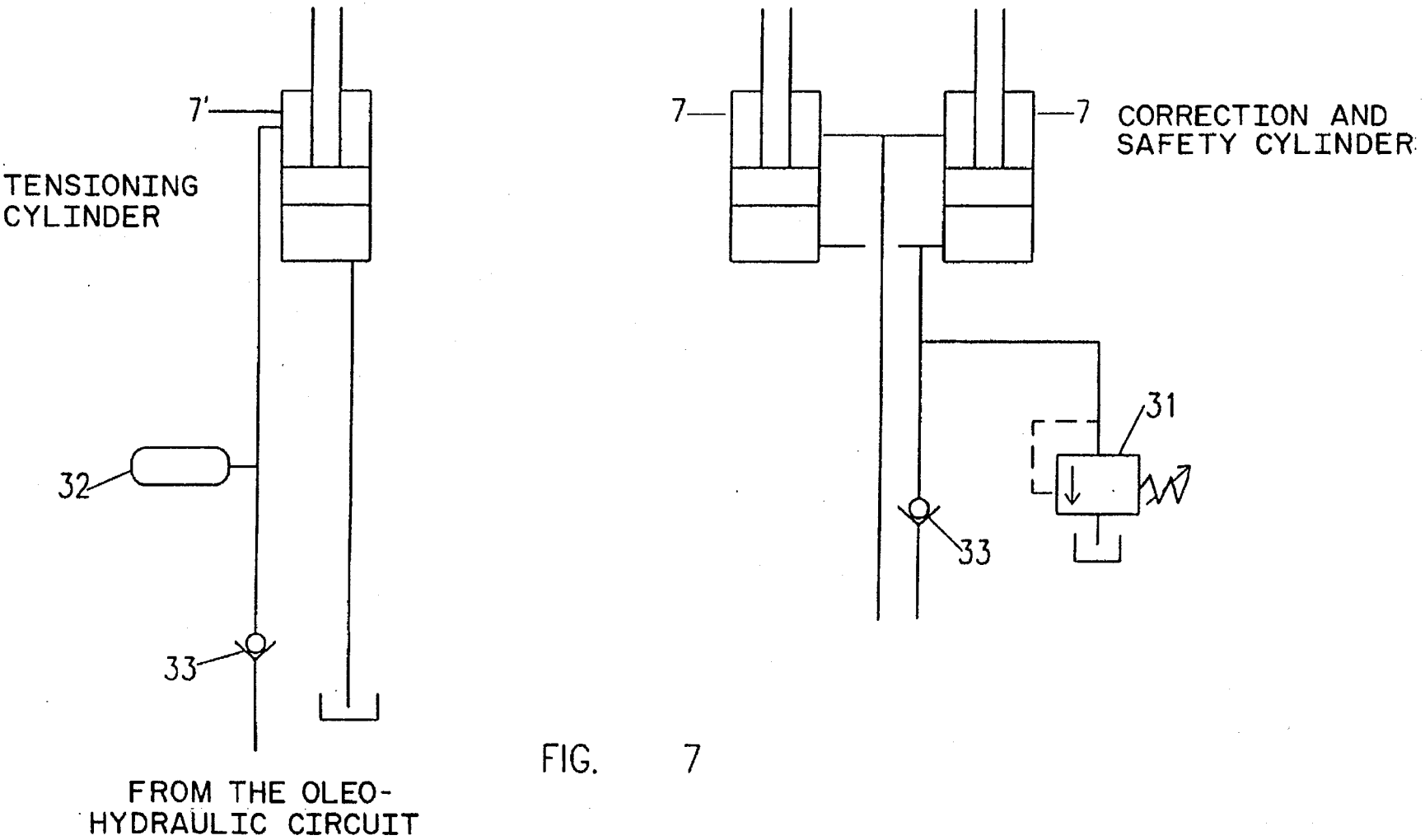

In the oleo-hydraulic scheme of FIG. 7, applicable to cylinders equipped with unilateral rotary couplings, the tensioning cylinder appears which serves to maintain the mobile jaw 4 in position and the said cylinders 7, also carrying out the function of salvaging clearances.

Figure 3:
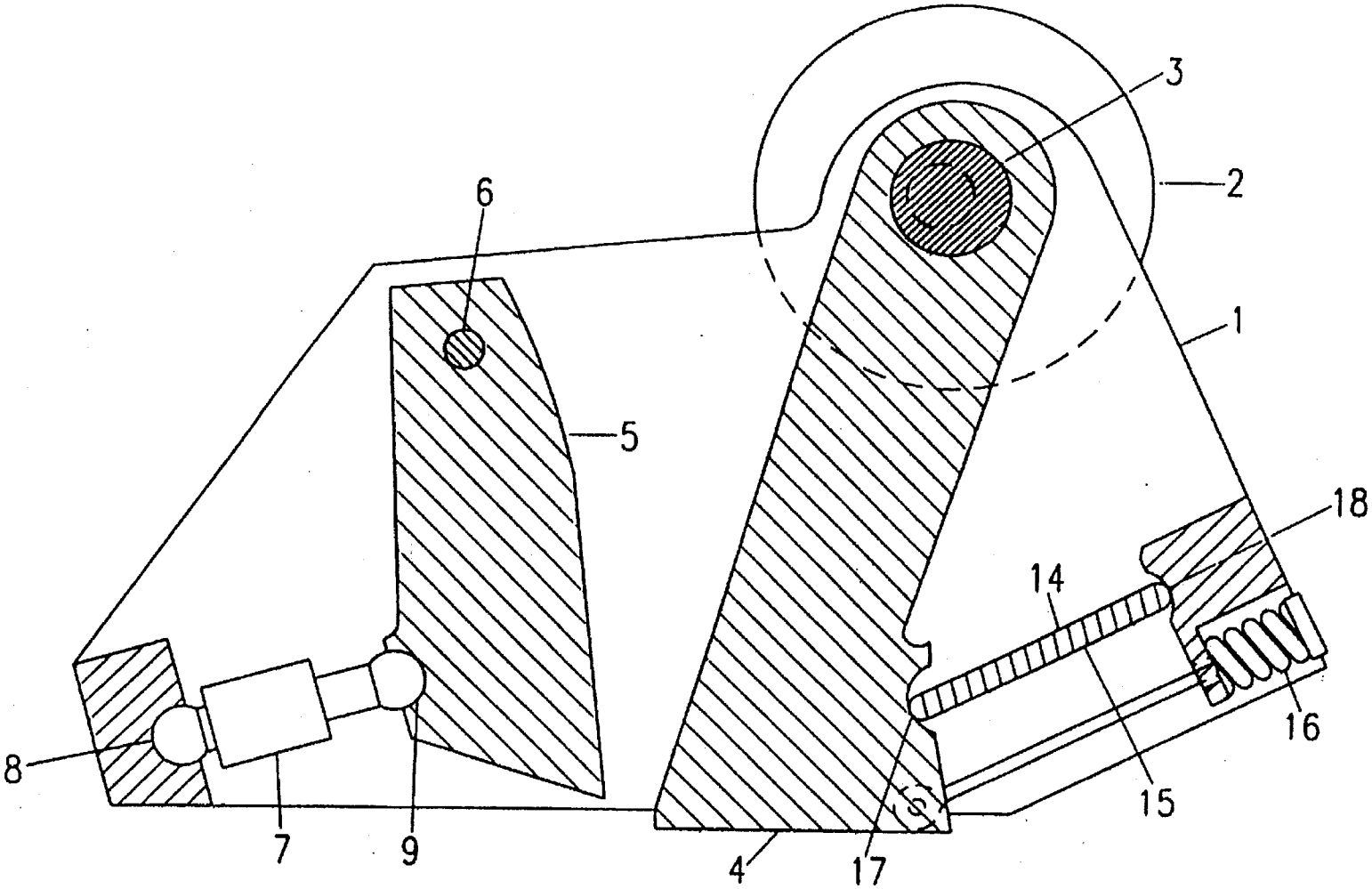
FIG. 3 shows a section of the crushing machine having a flag push-bar device on one side and a oleo-hydraulic cylinder device on the other side of two opposed moveable jaws as per DE-B-1237414 (KL ÖKENER-HUMBOLDT-DEUTZ AG.) structure, that provides the correction and safety cylinders placed behind the fixed jaw.

The functioning of the machine is the same as that in the crushing machines with traditional jaws, as far as it regards the normal treatment of the material to be crushed. When instead there is the necessity of adjusting the size of the material in exit, acting on the distance between fixed and mobile jaw, or when an uncrushable body enters the crushing chamber, between the fixed and mobile jaw, the functioning of the machine is the following:

in the illustrated configuration in FIG. 1 the cylinders 7 directly displace the mobile jaw 4 varying the distance of the fixed jaw 5, for the correction of the size of the material in exit, while the said cylinders 7 can allow the complete opening between the two jaws 4 and 5 when the calibration pressure of the maximum pressure valve 31 is exceeded; the said cylinders 7 furthermore, have the same function as the connecting rod 14 of the FIGS. 2, 3, 4 and 5 that analogously to the traditional crushing machines, as regards the kinematics of the movable jaw;

in the configuration of FIG. 2 the machine operates as in the traditional crushing machines, except that the rotary coupling 18 of the connecting rod 14 is not connected as in FIG. 1 to the body 1, namely to a fixed part of the machine, but is linked to the intermediate flag guide 10 that can rotate around pivot 34, thanks to cylinders 7 of correction and connected safety to the said intermediate flag guide 10 by means of the rotary couplings 9 and body 1 by means of the rotary couplings 8, the tie rod 15 and spring 16 being one of the traditional tensioning systems and the recovery of clearances of the unilateral rotary couplings 17 and 18 of the connecting rod 14;

in the configuration of FIG. 3 the whole part to the right of the "fixed" jaw 5, looking at the Figure, is analogous to that of a traditional crushing machine, while the "fixed" jaw 5 has its upper part hinged to the body 1 by means of hinge 6 and it is guided in its underside by the safety and correction cylinder 5, that is connected to the body 1 by means of the rotary coupling 8 and to the said "fixed" jaw by means of the rotary coupling 9, in this way the "fixed" jaw 5 stops in the set position during the normal functioning of the machine, but being-able to be displaced from cylinder 5 to vary the size of the material to be crushed in exit or being able to open itself with respect to the mobile jaw in case of the introduction, between the jaws of an uncrushable body, due to the overcoming of the maximum pressure in cylinders 7 and opening of the valve 31;

in the configuration of FIG. 4 the way of working of the machine is the same as that in the preceding configuration, except that between the "fixed" jaw 5 and the body 1 a dividing system for the effort coming from the mentioned "fixed" jaw 5 so as to be able to use cylinders 7 of simpler correction and safety, the said dividing devise being constituted of the effort of a couple of opposite connecting rods 19 and 20, agents respectively on the rotary coupling 22 with the "fixed" jaw 5 and on the rotary coupling 24 with the body 1 and both concurrent by means of the rotary couplings 21 and 23 on the shackle 11 connected to the cylinders 7, furthermore the said effort division device being similar to that commonly used in mills with double toggle for the actioning of the movable jaw, and finally having a tensioning device and the recovery of clearances known to the technique, constituted of tie rods 25 and springs 26;

in the configuration of FIG. 4 the way of working of the machine is the same as that in the preceding configuration, except that between the "fixed" jaw 5 and the body 1 an effort dividing system is inserted for the effort coming from the said "fixed" jaw 5 to be able to use cylinders 7 of simpler correction and safety, the said effort dividing device being constituted of one or more articulated wedges 12 endowed with sliding surfaces on the tilted faces that can slide on the surfaces 27 and 28 respectively solid to the body 1 and to the "fixed" jaw 5, the said articulated wedges being formed of two parts 35 and 36 connected between themselves by means of the rotary coupling 37, the said articulated wedges being moved from the correction and safety cylinders 7 and finally having the said effort division system for a tensioning device and the recovery of clearances known to the technique, constituted of tie rods 29 and springs 30.

We claim:

1. A crushing machine with a fixed jaw (5) and a mobile jaw (4), reciprocable in its upper mouth opening by rotating eccentric (3), said jaw being connected to an oleo-hydraulic adjustable opening device to vary the distance between the jaws a their exit mouth opening, for regulating the size of the material in exit, wherein said oleo-hydraulic adjustable opening device is an oleo-hydraulic cylinder means (7) placed between the body of the crusher and an intermediate guide by rotula connection said intermediate guide being connected to the said mobile jaw (4) at its lower back end by means of a push connecting rod equipped with a tensioning and recovery of clearances system (15, 16), characterised in that:

said intermediate guide is an oscillating flag (10):

on its upper end (34), hinged on the body of the crusher;

on its lower end, pulled by a tie rod (15), with the interposition of an helical spring (16), said oscillating flag (10), receiving in its intermediate position, said rotula connection (9) on one side, and said push connecting rod (14) on the other side, and wherein:

the opposite connections of said oleo-hydraulic cylinder means (7) to the body of the crusher (8), is made by rotula articulation too (8, 9);

said oleo-hydraulic cylinder means (7) has:

an adjustable over-pressure check valve (31) and a no return check valve (33), one being connected to one chamber and the other being connected to the opposite chamber of said oleo-hydraulic cylinder means.

2. A crushing machine as claimed in claim 1 characterised by cylinders (7) having 2 unidirectional rotula connections (8 and 9) plus a tensioning system made of an oleo-hydraulic cylinder means (7') having its stem-side chamber connected to an oleo-hydraulic accumulator (32), said accumulator being connected by means of a no return check valve (33) to an hydraulic system able to supply a pressure greater than the pressure necessary of the tensioning of the hydraulic cylinder means (7)—flag intermediate guide (10)—push connecting rod (14) ensemble.

3. Crushing machine as claimed in claim 1 characterized in that:

said oleo-hydraulic cylinder means (7) is connected to said body of the crusher (8) and to said flag (10), by bidirectional rotula articulation (8, 9), and the said oleo-hydraulic cylinder means (7) has:

an adjustable over-pressure check valve (31) connected to the chamber opposite to the stem; and a no return check valve (33) and an oleo-hydraulic accumulator (32), connected to the respective stem side chamber.

* * * * *